US007380315B1

(12) United States Patent
Jung

(10) Patent No.: US 7,380,315 B1
(45) Date of Patent: Jun. 3, 2008

(54) SYSTEMS AND METHODS FOR REINFORCING LOCKABLE TELESCOPING POLES

(76) Inventor: In-Soo Jung, 103-804 Hyundai Apt., 168-1 Sanghyun -Dong, Yongin-Si, Gyeonggi-Do (KR)

( * ) Notice: Subject to any disclaimer, the term of this patent is extended or adjusted under 35 U.S.C. 154(b) by 94 days.

(21) Appl. No.: 10/701,718

(22) Filed: Nov. 4, 2003

(51) Int. Cl.
*A45C 3/00* (2006.01)

(52) U.S. Cl. ..... 16/429; 16/2.1

(58) Field of Classification Search ..... 16/113.1, 16/405, 429, 440, 2.1–2.5, 2; 24/713.7; 403/109.1, 403/109.2, 109.3, 109.8; 70/209; 292/306; 135/75, 139–142
See application file for complete search history.

(56) References Cited

U.S. PATENT DOCUMENTS 1,031,024 A * 7/1912 Pickles ..... 24/713.7
1,074,077 A * 9/1913 Wismer ..... 24/689
2,232,306 A * 2/1941 Baldwin ..... 135/139
2,385,294 A * 9/1945 Lowy ..... 16/2.3
2,583,719 A * 1/1952 White ..... 16/2.1
3,648,324 A * 3/1972 Stradella et al. ..... 16/404
4,232,496 A * 11/1980 Warkentin ..... 403/288
4,241,472 A * 12/1980 Iannarone ..... 16/405
5,620,070 A * 4/1997 Wang ..... 190/115
5,743,577 A * 4/1998 Newman et al. ..... 294/19.1
5,984,064 A * 11/1999 Byington ..... 190/115
6,125,513 A * 10/2000 Cheraso et al. ..... 24/3.11
6,158,089 A * 12/2000 Monahan et al. ..... 16/429
6,213,890 B1 * 4/2001 Prince ..... 473/292
6,254,305 B1 * 7/2001 Taylor ..... 403/378
6,883,208 B1 * 4/2005 Huang ..... 16/429
2002/0095745 A1 * 7/2002 Wang ..... 16/405

* cited by examiner

*Primary Examiner*—William L. Miller
(74) *Attorney, Agent, or Firm*—Paul, Hastings, Janofsky & Walker LLP

(57) ABSTRACT

An external segment of a telescoping handle comprises an outer segment configured for receiving an internal segment. The outer segment comprises a hole configured to receive a locking pin attached to the internal segment. The external segment further comprises a reinforcing mechanism inserted into the hole that is configured to distribute forces imparted by the locking pin in such a manner that the hole does not deform as easily as in conventional baggage.

32 Claims, 5 Drawing Sheets

400

| Types of Specimens | | Max. Tensile Load (Newtons) |
|---|---|---|
| With Reinforcing Mechanism | 1 | 3,019 |
| | 2 | 2,989 |
| | 3 | 3,012 |
| | 4 | 3,108 |
| | 5 | 2,931 |
| Without Reinforcing Mechanism | 1 | 2,353 |
| | 2 | 2,412 |
| | 3 | 2,585 |
| | 4 | 2,093 |
| | 5 | 2,233 |

Fig. 4

SYSTEMS AND METHODS FOR REINFORCING LOCKABLE TELESCOPING POLES

BACKGROUND

1. Field of the Inventions

The field of the invention relates generally to wheeled carrying or transporting devices and more particularly to telescoping handles used to facilitate convenient conveyance of such devices.

2. Background Information

Recently, wheeled baggage, for example, has been equipped with telescoping handles. A conventional telescoping handle often comprises two telescoping poles, one on either side of the bag, each of which comprises two segments, an inner telescoping segment and an outer segment affixed to the bag itself. The telescoping poles allow the user to extend the handle to a comfortable length while pulling the bag. But the telescoping poles can be collapsed to allow the handle to be retracted whenever it is convenient, e.g., when the bag is stowed.

Locking pins are often used to secure the extended position of the handle to prevent handle from collapsing unexpectedly. Sometimes, the locking pins are spring loaded bearings that require substantial axial force to collapse the telescoping pole. In other cases, the locking pins are mechanically coupled to an actuator on the handle which does not disengage the lock unless the button is depressed. In other instances, a combination of an actuator and spring loaded bearings can be used. In any event, the locking pins must be received by a hole in opposite segment of the telescoping pole. Typically, the segments are hollow tubes with their inner width or diameters decreasing in size so as to allow each successive segment to fit inside one another.

FIG. 1 is a diagram illustrating how a locking mechanism is configured in relationship to two segments a telescoping pole. In the collapsed configuration illustrated on the left, a large portion of internal segment 102 resides within external segment 104. In the extended configuration illustrated on the right, a small portion of internal segment 102 can reside within external segment 104. It can be locked in this configuration with a locking mechanism comprising hole 106 in the external segment and locking pin 108 on the internal segment. The configuration is locked when locking pin 108 engages hole 106. Often, the locking pin 108 is mechanically coupled to a button (not shown) to retract the locking pin 108 when the user wishes to unlock the telescoping pole from the extended configuration.

When extended such that pin 108 is engaged with hole 106, the associated bag can be pulled by the handle. This can, however, introduces stress along the length of the telescoping pole. The heavier the bag and/or rougher the terrain across which the bag is being pulled, the greater the stresses can be. Further, some users have been known to lift a bag by the telescoping handle to overcome an obstacle. Such lifting can relieve all the weight from the wheels and impart the weight into a longitudinal force on the telescoping handle. The brunt of the stresses created along the handle is often imparted directly on the portion of segment 104 that form hole 106. The stresses are often enough to cause hole 106 to deform. In fact, even the act of extending a telescoping handle can cause stresses on hole 106 that can lead to deformation of hole 106.

Eventually, hole 106 can deform to such a degree that pin 108 will no longer engage hole 106 sufficiently. When this occurs, the handle will often collapse unexpectedly rendering the bag somewhat useless, at least for its intended purpose of being able to be wheeled about.

FIG. 2 illustrates the consequence of prolonged or intense longitudinal forces on a hole 106 of a telescoping handle. As can be seen on the right, hole 106 can become enlarged and distorted as a result of excessive or prolonged exposure to longitudinal forces from locking pin 108. Again, the result of the distortion is that the locking pin 108 no longer engages the hole in a secure manner, leading to play in the telescoping handle even when locked. This can lead to instability in navigating the bag, possibly to the point of rendering the telescoping handle inoperable.

One cause for the resulting distortion illustrated in FIG. 2 is the fact that pole segment 104 is often comprised of a light weight weaker material, such as aluminum, as compared to locking mechanism 108, which is often made from a more durable stronger material such as steel or iron.

SUMMARY OF THE INVENTION

An external segment of a telescoping handle comprises an outer segment configured for receiving an internal segment. The outer segment comprises a hole configured to receive a locking pin attached to the internal segment. The external segment further comprises a reinforcing mechanism inserted into the hole that is configured to distribute forces imparted by the locking pin in such a manner that the hole does not deform as easily as in conventional transporting devices.

In one aspect, the area of the external segment around the hole is recessed to permit the inclusion of the reinforcing mechanism so that the reinforcing mechanism does not obstruct the movement of inner segment as it traverses between a extended and collapsed configurations.

These and other features, aspects, and embodiments of the invention are described below in the section entitled "Detailed Description of the Preferred Embodiments."

BRIEF DESCRIPTION OF THE DRAWINGS

Features, aspects, and embodiments of the inventions are described in conjunction with the attached drawings, in which:

FIG. 4 is a table illustrating the improved performance of the a telescoping handle comprising the reinforced hole of FIG. 3.

DETAILED DESCRIPTION OF THE PREFERRED EMBODIMENTS

A telescoping pole of the type described above can be reinforced by distributing the force imparted by the locking pin onto the boundary of the hole in the external segment. As described iii more detail below, such reinforcement can be accomplished, in accordance with the systems and methods described herein, by enlarging the hole in the external segment so that a reinforcing mechanism can be inserted into the enlarged hole. The reinforcing mechanism can for example, comprise a metal eyelet of an appropriate size and shape to receive the locking pin. Thus, the reinforcing mechanism can be inserted into the enlarged hole and attached to the external segment. Attachment can be achieved using an adhesive, welding, fastening with a fastener, or mechanically binding for example by crimping the mechanism onto the external segment.

When locked, the locking pin is inserted into the reinforcing mechanism and imparts a force longitudinal to the telescoping pole onto the reinforcing mechanism. The reinforcing mechanism distributes this force along the boundary of the hole on the external segment. Accordingly, the boundary of the hole is better able to with stand the forces exerted by the locking pin without distorting. The reinforcing mechanism, however, is now subject to the same concentrated forces that the original hole was. To prevent the reinforcing mechanism from succumbing to the same sort of distortion, the mechanism can either comprise a stronger material such as steel and/or the mechanism can have a height greater than the thickness of the wall of the external segment.

Often, the segments of a telescoping pole fitted relatively tightly, where a reinforcing mechanism can obstruct the movement of the internal segment within the external segment. To overcome this difficulty, the region surrounding the hole can be recessed. Recessing can accomplished by several methods such as removing material from the external segment or displacing it outwardly. The recess should be at least deep enough to prevent the reinforcing mechanism from obstructing the movement of the internal segment. Depending on the embodiment, the recess can be configured to allow the reinforcing mechanism to reside either flush with the interior surface of the external segment or below the interior surface of the external segment.

Figure 3:
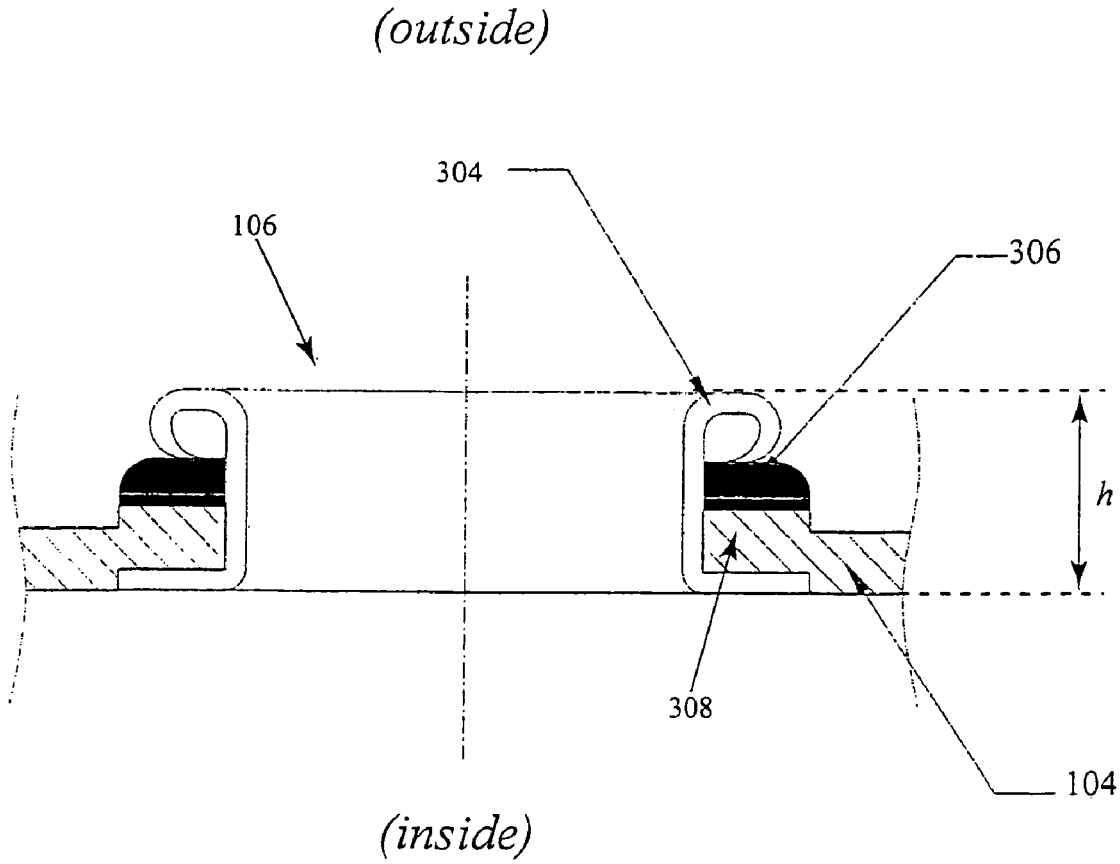
FIG. 3 is a diagram illustrating a reinforced hole in accordance with one embodiment.

FIG. 3 is a diagram illustrating a reinforcing mechanism configured in accordance with one example embodiment of the systems and methods described herein. In the example embodiment of FIG. 3, the reinforcing mechanism comprises a metal eyelet 304. The upper half of FIG. 3 corresponds with the outside of a hollow segment 104, while the lower half corresponds with the inside of segment 104. In one specific implementation, eyelet 304 is a stainless steel eyelet; however, it will be understood that any type of metal, or other material, can be used, as along as it is sufficient for achieving the results described herein. The reinforcing mechanism also comprises a washer 306, which is configured to secure eyelet 304 and add strength to the overall assembly. Methods for installing eyelets and washers are well known and will not be described in detail here.

Thus, in the embodiment illustrated in FIG. 3, hole 106 is expanded to a sufficient diameter to accommodate eyelet 304, which is installed in outer segment 104. The curvature of the upper part of eyelet 304 can serve to add additional strength to the reinforcing mechanism. Additionally, the height (h) of eyelet 304 can be selected so as to increase the extent to which forces exerted on eyelet 304 are distributed across eyelet 304 and across hole 106. Accordingly, locking pin 108 can engage external portion 104 through the inner diameter of eyelet 304.

Figure 1:
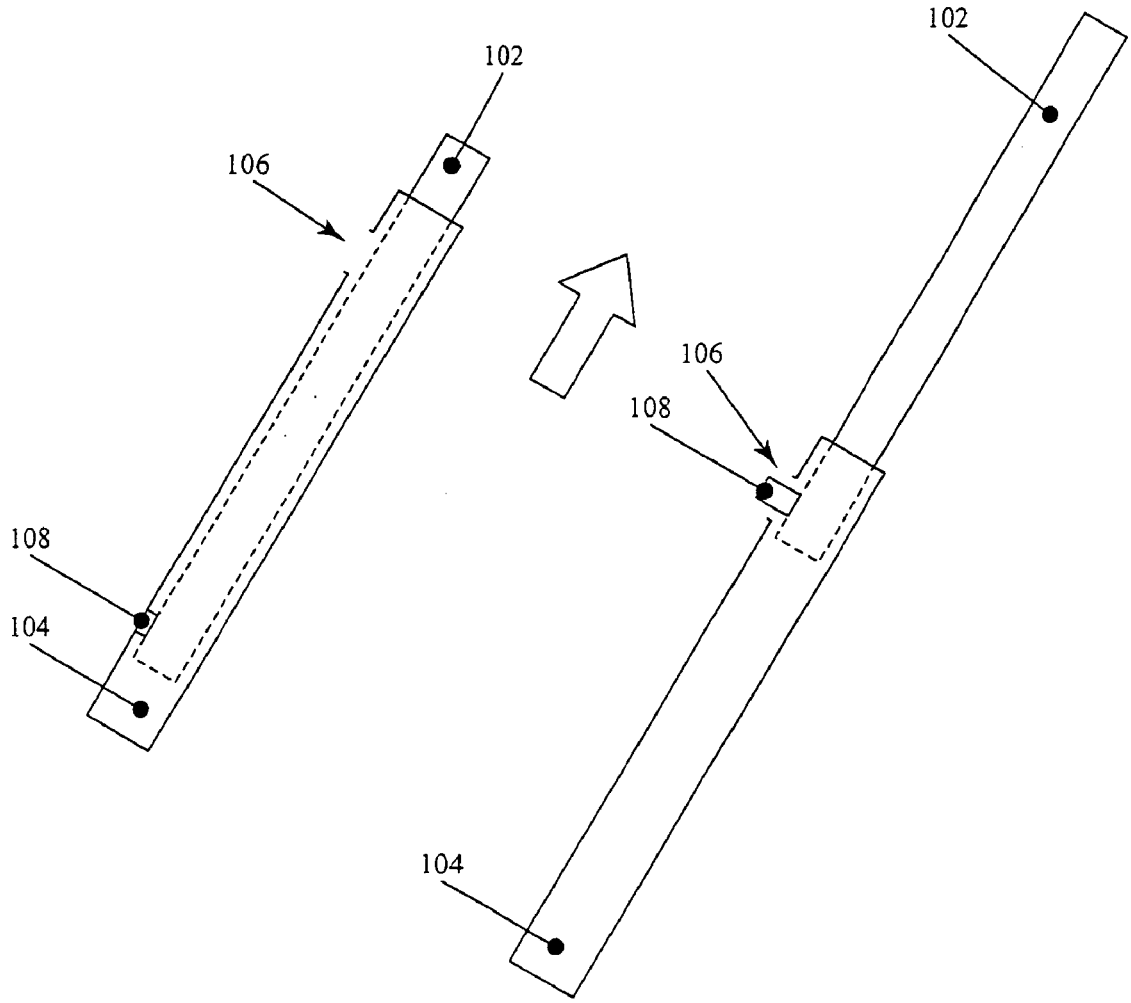
FIG. 1 is a diagram illustrating the operation of a locking mechanism in relation to two segments of a telescoping pole.
Figure 2:
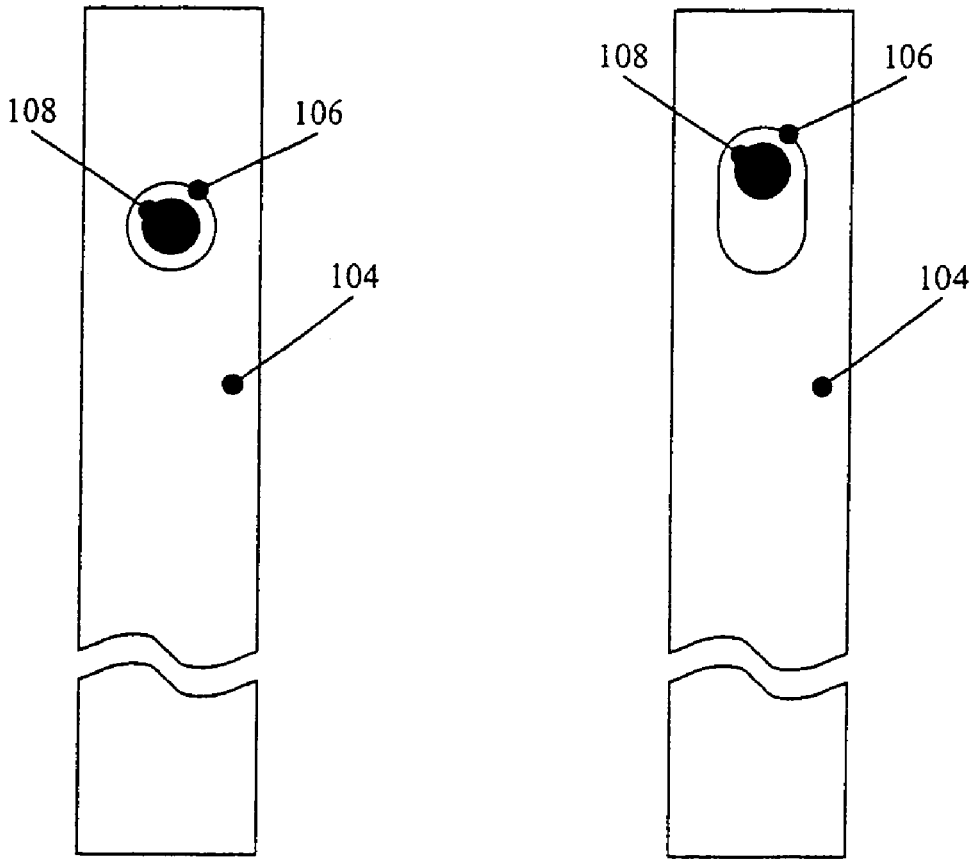
FIG. 2 is a diagram illustrating consequences of prolonged or intense longitudinal forces on a telescoping pole.

The area 308 of external segment 104 can be displaced sufficiently to allow the lower portion of eyelet 304 to fit flush against the inner surface of external segment 104. This can allow an inner segment 102 and locking pin 108 to move freely without snagging on the reinforcing mechanism. This can be important because as illustrated in FIG. 1, inner segment 102 must be free to travel freely along the inside of external segment 104 for the telescoping handle to operate effectively.

Thus, when a hole 106 is reinforced using a reinforcing mechanism, such as the one described in relation to FIG. 3, the telescoping assembly can withstand greater stresses and survive longer periods of use before failing. FIG. 4 is a table 400 illustrating the improved performance of a telescoping handle that incorporates the reinforcing mechanism of FIG. 3. Table 400 illustrates the maximum tensile load that a telescoping handle was able to withstand before hole 106 deformed sufficiently to cause failure. The test was run 5 times with the reinforcing mechanism of FIG. 3, and 5 times without. The upper half of table 400 illustrates the results for the 5 tests run with the reinforcing mechanism. The lower half of table 400 illustrates the results of r the 5 tests run without the reinforcing mechanism. Clearly, on average, the reinforced telescoping handle can tolerate a much higher tensile load than a telescoping handle that does not include a reinforcing mechanism.

Figure 5:
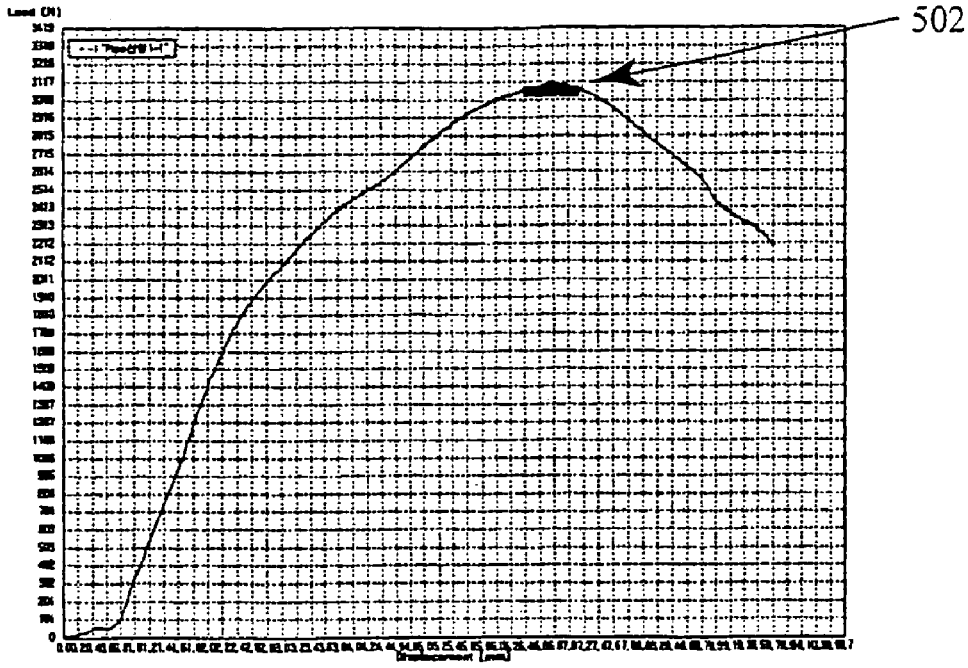
FIG. 5 is a graph illustrating the improved performance of the a telescoping handle comprising the reinforced hole of FIG. 3.
Figure 5:
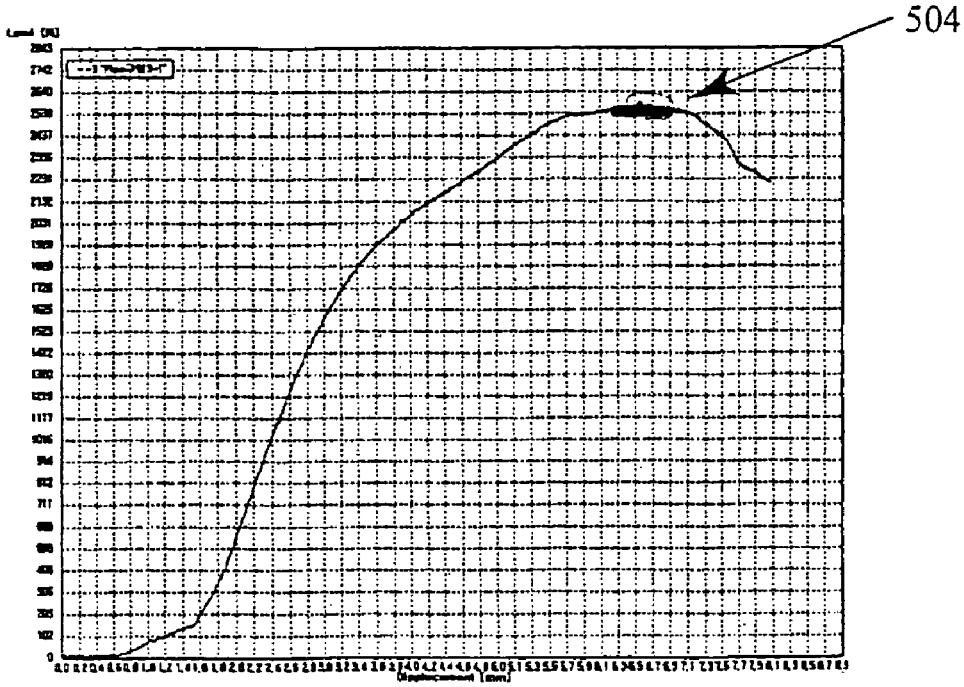

The maximum tensile load can be measured by observing the amount of deformation of the hole in relation to the tensile load. The point at which additional load is required to further deform the hole can be used as the maximum tensile load. This can be observed in a typical graphs of both the reinforced and un-reinforced telescoping handles shown in FIG. 5. The graphs of FIG. 5 depict a plotting of deformation of hole 106 as a function of tensile load, for a reinforced (upper graph) and un-reinforced (lower graph) telescoping handles. At points 502 and 504, respectively, deformation continues even though the tensile load has been reduced, denoting the maximum tensile load. Again, it can be seen that the reinforced telescoping handle can withstand greater tensile loads before harmful deformation occurs.

It should be noted that embodiments described herein are in relation to telescoping handles in which hole 106 resides in an external segment 104, while locking in 108 resides in an inner segment 102; however, the systems and methods described herein can also be employed in a reverse configuration. Although, the reverse configuration is not often used in conventional telescoping handle assemblies.

Further, hole 106 is illustrated in the above embodiments as a circular hole; however, hole 106 can comprise alternative dimensions and shapes. For example, hole 106 can be oblong or square depending on the implementation. When such is the case, an alternative, or modified, reinforcing mechanism can be used to achieve the same results described herein. Eyelets, however, have the advantage of well known and efficient installation methods and tools.

It should also be noted that a reinforced handle assembly can be built from the beginning to include a reinforcing mechanism such as the reinforcing mechanism of FIG. 3. Alternatively, existing telescoping handle assemblies can be retrofitted to include such a reinforcing mechanism. This will likely require that the telescoping handle assembly be removed and taken apart so that reinforcing mechanisms can be installed; however, retrofitting is probably not economically feasible in large numbers. Still, retrofitting can be used to increase the life of a particular transporting device in specific instances.

Further, an external segment 104 can comprise a plurality of reinforced holes 106. For example, external segment can comprise one hole configured to be engaged by locking pin 108 when internal segment 102 is in the collapsed position another hole 106 configured to be engaged by locking point 108 when internal segment 102 is in the extended position. In other embodiments, internal segment 102 can comprise a plurality of locking pins. Thus, external segment 104 can comprise a plurality of corresponding reinforced holes 106 both at the extended and collapsed positions as required.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed is:

1. A telescoping handle, comprising:

an inner segment, the inner segment comprising a locking pin; and an external segment, the external segment comprising:

a member with an external surface and an internal surface;

a hole through the member extending from the internal surface to the external surface, the hole configured to receive the locking pin; and a reinforcing mechanism inserted inside the hole, secured to the member, and not projecting beyond the internal surface, wherein the reinforcing mechanism is configured to reinforce the hole in such a manner as to distribute forces imparted by the locking pin.

2. The telescoping handle of claim 1, wherein the internal surface comprises an L-shaped recess surrounding the hole and the external surface comprises a raised lip surrounding the hole, wherein the recess of the internal surface and the raised lip of the external surface form a shoulder.

3. The telescoping handle of claim 1, wherein the reinforcing mechanism further comprises a washer.

4. The telescoping handle of claim 1, wherein the reinforcing mechanism comprises:

a main body residing adjacent to the hole through the member;

a lower portion extending orthogonally from the main body and residing flush with the internal surface of the member; and an upper portion extending in a curvature from the main body, the curvature residing adjacent to an external surface of the member.

5. The telescoping handle of claim 1, wherein the reinforcing mechanism comprises a height selected to aid the distribution of the forces imparted by the locking pin.

6. The telescoping handle of claim 1, wherein the reinforcing mechanism is positioned to not impede the movement of the inner segment.

7. The telescoping handle of claim 1 wherein the member is constructed from aluminum.

8. The telescoping handle of claim 1, wherein the reinforcing mechanism is constructed from stainless steel.

9. The telescoping handle of claim 1, wherein the inner segment is configured to slide within the external segment between an extended position and a collapsed position.

10. The telescoping handle of claim 9, wherein the locking pin is configured to engage the hole when the inner segment is in the extended position.

11. The telescoping handle of claim 9, wherein the locking pin is configured to engage the hole when the inner segment is in the collapsed position.

12. The telescoping handle of claim 1, wherein the external segment comprises a first material, and the locking pin comprises a second material that is stronger than the first material.

13. The telescoping handle of claim 12, wherein the second material is stainless steel.

14. The telescoping handle of claim 1, wherein the member further comprises a plurality of holes, and for each of the plurality of holes, a reinforcing mechanism is inserted inside the hole, secured to the member, and configured to reinforce the hole in such a manner as to distribute forces imparted by the locking pin.

15. The telescoping handle of claim 1, further comprising a plurality of telescoping handles, each of the telescoping handles comprising:

an inner segment, the inner segment comprising a locking pin; and an external segment, the external segment comprising:

a member with an external surface and an internal surface;

a hole through the member extending from the internal surface to the external surface, the hole configured to receive the locking pin; and a reinforcing mechanism inserted inside the hole, secured to the member, and not projecting beyond the internal surface, wherein the reinforcing mechanism is configured to reinforce the hole in such a manner as to distribute forces imparted by the locking pin.

16. A transporting device, comprising:

a telescoping handle, the telescoping handle comprising:

an inner segment, the inner segment comprising a locking pin; and an external segment, the external segment comprising:

a member with an external surface and an internal surface;

a hole through the member extending from the internal surface to the external surface, the hole configured to receive the locking pin; and a reinforcing mechanism inserted inside the hole, secured to the member, and not projecting beyond the internal surface, wherein the reinforcing mechanism is configured to reinforce the hole in such a manner as to distribute forces imparted by the locking pin.

17. The transporting device of claim 16, wherein the internal surface comprises an L-shaped recess surrounding the hole, and the external surface comprises a raised lip surrounding the hole, wherein the recess of the internal surface and the raised lip of the external surface form a shoulder.

18. The transporting device of claim 16, wherein the reinforcing mechanism further comprises a washer.

19. The transporting device of claim 16, wherein the reinforcing mechanism comprises:

a main body residing adjacent to the hole through the member;

a lower portion extending orthogonally from the main body and residing flush with the internal surface of the member; and an upper portion extending in a curvature from the main body, the curvature residing adjacent to an external surface of the member.

20. The transporting device of claim 16, wherein the reinforcing mechanism comprises a height selected to aid the distribution of the forces imparted by the locking pin.

21. The transporting device of claim 16, wherein the reinforcing mechanism is positioned to not impede the movement of the inner segment.

22. The transporting device of claim 16, wherein the member is constructed from aluminum.

23. The transporting device of claim 16, wherein the reinforcing mechanism is constructed from stainless steel.

24. The transporting device of claim 16, wherein the inner segment is configured to slide within the external segment between an extended position and a collapsed position.

25. The transporting device of claim 24, wherein the locking pin is configured to engage the hole when the internal segment is in the extended position.

26. The transporting device of claim 24, wherein the locking pin is configured to engage the hole when the internal mechanism is in the collapsed position.

27. The transporting device of claim 16, wherein the external segment comprises a first material, and wherein the locking pin comprises second material that is stronger than the first material.

28. The transporting device of claim 27, wherein the second material is stainless steel.

29. The transporting device of claim 16, wherein the member further comprises a plurality of holes, and for each of the plurality of holes, a reinforcing mechanism is inserted inside the hole, secured to the member, and configured to reinforce the hole in such a manner as to distribute forces imparted by the locking pin.

30. The transporting device of claim 16, further comprising a plurality of telescoping handles, each of the telescoping handles comprising:

an inner segment, the inner segment comprising a locking pin; and an external segment, the external segment comprising:

a member with an external surface and an internal surface;

a hole through the member extending from the internal surface to the external surface, the hole configured to receive the locking pin; and a reinforcing mechanism inserted inside the hole, secured to the member, and not projecting beyond the internal surface, wherein the reinforcing mechanism is configured to reinforce the hole in such a manner as to distribute forces imparted by the locking pin.

31. A telescoping handle, comprising:

an inner segment and an external segment, the external segment telescopically receiving the inner segment so that the inner segment is telescopically extendable from the external segment along a longitudinal axis of the external segment;

the inner segment having a locking pin outwardly extending therefrom;

the external segment having a side wall having a hole therethrough, the locking pin being extendable through the hole;

an exterior surface of the side wall having an annular raised lip extending along a periphery of the hole;

an interior surface of the side wall having an annular recess along the periphery of the hole, the recess having a generally L-shaped cross-sectional contour taken along the plane extending through the longitudinal axis of the external segment;

an annular washer positioned against the raised lip and having an outer perimeter with a radius substantially equal to the outer radius of the raised lip;

an eyelet having a middle portion extending through the hole and the washer, and an outer portion outwardly extending from the hole with a curved outer edge curling back towards and in contact with the washer;

the eyelet further having an inner portion extending into the recess of the interior surface of the side wall with an exposed face of the inner portion of the eyelet lying substantially flush with the inner face of the side wall; and the raised portion, washer and eyelet affording additional support to the side wall of the external segment to help reduce deformation of the hole by the locking pin when extended through the hole.

32. The telescoping handle of claim 31, wherein the raised portion, washer and eyelet provide additional support to the side wall of the external segment to afford an increase by at least 16.5% to a maximum tensile load that can be exerted on the telescoping handle before deformation of the hole.

* * * * *